US005744430A

United States Patent [19]

Inoue et al.

[11] Patent Number: 5,744,430

[45] Date of Patent: Apr. 28, 1998

[54] ENGINE OIL COMPOSITION

[75] Inventors: Kiyoshi Inoue; Yasuhisa Yamada; Akira Yaguchi; Masakuni Hirata, all of Yokohama, Japan

[73] Assignee: Nippon Oil Co., Ltd., Tokyo, Japan

[21] Appl. No.: 637,482

[22] Filed: Apr. 25, 1996

[30] Foreign Application Priority Data

Apr. 28, 1995 [JP] Japan ..... 7-127351
Jun. 15, 1995 [JP] Japan ..... 7-172698

[51] Int. Cl.[6] ..... C10M 141/00

[52] U.S. Cl. ..... 508/295; 508/365; 508/376; 508/378

[58] Field of Search ..... 252/39, 49.6, 49.7; 508/295, 291, 376, 378, 365

[56] References Cited

U.S. PATENT DOCUMENTS 4,098,705 7/1978 Sakurai et al. ..... 508/266
4,529,526 7/1985 Inoue et al. ..... 508/376
4,539,126 9/1985 Bleeker et al. ..... 508/186
4,681,694 7/1987 Zoleski et al. ..... 508/378
4,965,004 10/1990 Schlicht et al. ..... 508/186

*Primary Examiner*—Margaret Medley
*Attorney, Agent, or Firm*—Ostrolenk, Faber, Gerb & Soffen, LLP

[57] ABSTRACT

There is provided a composition having therein a base oil with a specified kinematic viscosity and with a specified total amount of aromatics, comprising, in specified amounts based on the total weight of the composition:

(b) an alkaline earth metal salicylate detergent;

(c) a zinc dialkyldithiophosphate;

(d) a succinimide ashless dispersant containing a polybutenyl group having a specified number-average molecular weight;

(e) a phenol ashless antioxidant;

(f) a molybdenum dithiocarbamate friction modifier; and (g) a viscosity index improver in such an amount that the kinematic viscosity of said composition ranges from 5.6 to 12.5 $mm^2/s$ at 100° C. The present invention provides an engine oil which has excellent fuel consumption and maintains the fuel consumption for a long period of time.

11 Claims, No Drawings

ENGINE OIL COMPOSITION

BACKGROUND OF THE INVENTION

1. Field of the Invention

The present invention relates to an engine oil composition. The present invention provides an engine oil composition useful for reducing fuel consumption. More particularly, the present invention provides an engine oil composition capable of reducing fuel consumption over a long period of time.

2. Background Art

Studies on fuel consumption for motor vehicles have been carried out since the oil crisis happened. However, from the viewpoints of resource conservation and environmental protection, fuel consumption still remains as one of the important issues to be solved. Such fuel consumption has been improved by reducing the weight of the car body, enhancing fuel combustion efficiency, and reducing the friction between mechanical parts of an engine. Measures to reduce the friction between mechanical parts of the engine, for example, improvement in valve mechanisms, reduction in the number of piston rings, reduction in the surface roughness of sliding members, and use of a small fuel-consumption engine oil.

Of those measures, the use of a small fuel-consumption engine oil has become popular in markets due to its excellent cost performance. In order to use a small fuel-consumption engine oil, it is required to develop a formulation which serves (1) to lower the viscosity of the engine oil so that the friction loss under hydrodynamic lubrication conditions at, for example, piston systems and bearings, is reduced and (2) to reduce the friction of valve systems under mixed lubrication conditions.

In general, a friction modifier (FM) is added to an engine oil as a useful additive for reducing friction. However, the friction modifier may function well enough as long as the engine oil is associated with other additives. In addition, it is important to choose a suitable base oil. The engine oil should have a long lifetime so that small fuel consumption is obtained after driving a long distance which otherwise results in deterioration of the engine oil. While the friction modifier typically provides an excellent effect when used in a virgin oil, i.e., in an oil which has not deteriorated, it encounters a problem that the effect of reducing fuel consumption decreases as the engine oil deteriorates during the operation of the engine.

Accordingly, in order to overcome those problems, it would be desirable to develop an engine oil which provides small fuel consumption and a long lifetime.

SUMMARY OF THE INVENTION

It is therefore an object of the present invention to provide an engine oil which provides small fuel consumption and a long lifetime.

As a result of tremendous studies to overcome the above-mentioned problems, the present inventors have found that an engine oil with a certain composition provides small fuel consumption and a long lifetime. The present invention was thus achieved.

More particularly, the present invention provides an engine oil composition comprising:

(a) a base oil having a kinematic viscosity of from 2 to 8 $mm^2/s$ at 100° C. and a total amount of aromatics of 15% by weight or less;

(b) an alkaline earth metal salicylate detergent in an amount of from 0.5% to 1.2% by weight as converted to the concentration of sulfated ash;

(c) a zinc dialkyldithiophosphate in an amount of from 0.04 to 0.10% by weight as converted to the concentration of phosphorus;

(d) a succinimide ashless dispersant in an amount of from 0.05 to 0.20% by weight as converted to the concentration of nitrogen, the succinimide ashless dispersant containing a polybutenyl group having a number-average molecular weight of from 900 to 3500;

(e) a phenol ashless antioxidant in an amount of from 0.1 to 3.0% by weight;

(f) a molybdenum dithiocarbamate friction modifier in an amount of from 0.02 to 0.15% by weight as converted to the concentration of molybdenum; and (g) a viscosity index improver in such an amount that the kinematic viscosity of the composition ranges from 5.6 to 12.5 $mm^2/s$ at 100° C.;

wherein the weight percentages in the components (b), (c), (d), (e) and (f) are based on the total weight of the engine oil composition.

DETAILED DESCRIPTION OF THE PREFERRED EMBODIMENTS

Hereinafter, the present invention will be described in detail.

The base oil as the component (a) of the engine oil composition according to the present invention is defined by measuring the kinematic viscosity at 100° C. (hereinafter, unless otherwise specified, kinematic viscosity is the one measured at 100° C.) and the amount of aromatics. The kinematic viscosity of the base oil ranges from 2 to 8 $mm^2/s$.

Importantly, the upper limit of the total amount of aromatics in the base oil should be 15% by weight.

The base oil having a total amount of aromatics above the upper limit set forth before, can not exhibit a synergistic effect between the base oil and each additive, or effect reduction in friction for a long period of time, even if the kinematic viscosity falls within the range defined by the present invention. The lower limit of the total amount of aromatics is not specifically limited; however, when the total amount of aromatics is less than 2% by weight, each additive may not dissolve sufficiently in the base oil and hence most preferably the total amount of aromatics should be 2% by weight or more. The most preferable range of the total amount of aromatics may be 2~8% by weight.

The total amount of aromatics as used herein corresponds to the amount of aromatics fraction determined in accordance with ASTM D2549. In general, such aromatics fraction includes alkylbenzenes, alkylnaphthalenes, anthrathene, phenanthrene, and alkylated derivatives thereof; condensed-ring compounds having fused therein at least 4 benzene rings; and heteroaromatic compounds such as pyridines, quinolines, phenols, and naphthols.

The base oil according to the present invention may include mineral oils, synthetic oils, and mixtures thereof. However, in order to obtain a base oil with a total amount of aromatics of 15% by weight or less, preferably from 2 to 15% by weight, and most preferably from 2 to 8% by weight, generally used are a mineral oil alone, a mixture of a mineral oil and a synthetic oil without aromatic moieties, and a mixture of a synthetic oil with aromatic moleties and a synthetic oil without aromatic moieties.

When a mineral oil and a synthetic oil without aromatic moieties are used, the total amount of aromatics in a mineral oil used may exceed 15% by weight unless the total amount of aromatics in the mixed oil exceeds 15% by weight.

Mineral oils described herein include oils which are refined by at least one of the processes such as solvent deasphalting, solvent extraction, hydrogenation, solvent dewaxing, and hydrotreatment of the lubricating oil fraction obtained by the normal pressure and/or vacuum distillation of crude oil.

Furthermore, synthetic oils with aromatic moieties include alkyl naphthalenes and alkyl benzenes.

In addition, examples of synthetic oils without aromatic moieties include poly-α-olefins such as polybutene, 1-octene oligomer and 1-decene oligomer, or hydrogenated derivatives thereof; diesters such as ditridecyl glutarate, di-2-ethylhexyl adipate, diisodecyl adipate, ditridecyl adipate, and di-3-ethylhexyl sebacate; and polyol esters such as trimethylolpropane caprylate, trimethylolpropane pelargonate, pentaerythritol-2-ethylhexanoate, and pentaerythritol pelargonate.

Alkaline earth metal salicylate detergents which are one of the essential components of the engine oil composition according to the present invention (hereinafter, referred to as the component (b)) suitably include a calcium salicylate detergent, a magnesium salicylate detergent, or a mixture thereof. In addition, the component (b) includes a neutral alkaline earth metal salicylate or over basic alkaline earth metal salicylate. The neutral alkaline earth metal salicylate as used herein is a salt in which hydrocarbon substituted salicylic acid is neutralized with equivalent moles of alkaline earth metal hydroxide. Such a neutral alkaline earth metal salicylate may be represented by the following general formula (I):

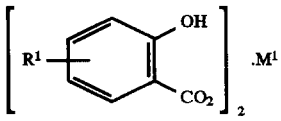

(I)

wherein $R^1$ is a hydrocarbon group such as a straight or branched alkyl, alkenyl, aryl, alkylaryl, and arylalkyl groups, especially an alkyl group; the alkyl group has from 12 to 30, preferably from 14 to 18 carbon atoms; examples of the alkyl group include dodecyl, tridecyl, tetradecyl, pentadecyl, hexadecyl, heptadecyl, octadecyl, nonadecyl, icosyl, henicosyl, docosyl, tricosyl, tetracosyl, pentacosyl, hexacosyl, heptacosyl, octacosyl, nonacosyl, and triacontyl groups, which may be straight or branched.

In introduction of an alkyl group, a mixture of α-olefins may be used, resulting in a mixture of neutral alkaline earth metal salicylates each of which has a different alkyl group.

In the general formula (I), $M^1$ is calcium or magnesium.

Over basic alkaline earth metal salicylates may be obtained by over-basifying a neutral alkaline earth metal salycilates with alkaline earth metal carbonates such as calcium carbonate and magnesium carbonate or alkaline earth metal borates such as magnesium borate.

The base number of the component (b) (according to JIS K2501 Perchloric Acid Method) is not particularly limited; however, the base number is in the range of from 60 to 350 mgKOH/g, preferably from 150 to 350 mgKOH/g.

In the engine oil composition according to the present invention, the amount of the component (b) is in the range of from 0.5 to 1.2% by weight as converted to the concentration of sulfated ash. When the amount of the component (b) is less than 0.5% by weight set forth above, the friction factor of the composition increases with deterioration of the engine oil and hence maintaining good fuel consumption is impossible; when the amount of the component (b) is more than 1.2% by weight set forth above, the fuel consumption can not be sufficiently reduced, which is not desirable.

Sulfated ash as described herein is defined in accordance with JIS K2272 where a sample is subjected to combustion and sulfuric acid is then added to the resulting carbonization residue, followed by heating to reach a constant weight.

Zinc dialkyldithiophosphate which is one of the essential components of the engine oil composition according to the present invention (hereinafter, referred to as the component (c)) includes such compounds as represented by the following general formula (II):

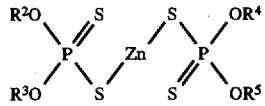

(II)

wherein $R^2$, $R^3$, $R^4$, and $R^5$ are each independently a straight or branched alkyl group having from 2 to 18, preferably from 3 to 8 carbon atoms, examples of which include a straight or branched ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups (those alkyl groups may be primary, secondary, or tertiary ones); when $R^2$, $R^3$, $R^4$, and $R^5$ are introduced, a mixture of α-olefins may be used as a starting material, resulting in a mixture of zinc dialkyldithiophosphates each of which has an alkyl group with a different structure.

In the engine oil composition according to the present invention, the amount of the component (c) is in the range of from 0.04 to 0.10% by weight based on the total weight of the engine oil composition as converted to the concentration of phosphorus.

When the amount of the component (c) is less than 0.04% by weight set forth above, the friction factor of the composition increases with deterioration of the engine oil and hence maintaining good fuel consumption is impossible; when the amount of the component (c) is more than 0.10% by weight set forth above, three-component catalysts are rapidly poisoned, thereby adversely affecting exhaust gas. Accordingly, both of the cases above are not preferred.

Succinimide ashless dispersants which are one of the essential components of the engine oil composition according to the present invention (hereinafter, referred to as the component (d)) include monoimides represented by the following general formula (III) and bisimides represented by the following general formula (IV):

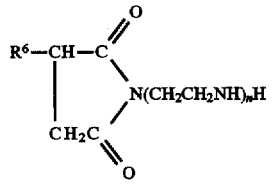

(III)

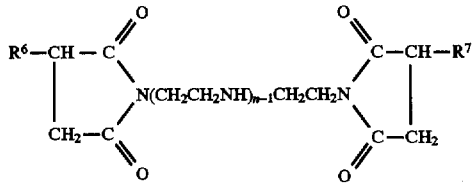

(IV)

wherein $R^6$ and $R^7$ are each independently a polybutenyl group having a number-average molecular weight of from 900 to 3500 and n is an integer from 2 to 5. The polybutenyl group as described herein is derived from polybutene which is obtained by polymerizing a mixture of 1-butene and isobutene.

A process for preparing the component (d) is not particularly limited; however, the component (d) may be obtained, for example, by reacting polybutene having a number-average molecular weight of from 900 to 3500 or chlorinated polybutene having a number-average molecular weight of from 900 to 3500 with maleic anhydride at a temperature of from 100° to 200° C., followed by reacting the resultant polybutenyl succinic acid with polyamine. Examples of polyamines include diethylenetriamine, triethylenetetramine, tetraethylenepentamine, and pentaethylenehexamine.

In the engine oil composition according to the present invention, the amount of the component (d) is in the range of from 0.05 to 0.20% by weight and most preferably of from 0.05 to 0.10% by weight based on the total weight of the engine oil composition as converted to the concentration of nitrogen.

When the amount of the component (d) is less than 0.05% by weight set forth above, sufficient reduction in friction can not achieved; when the amount of the component (d) is more than 0.20% by weight set forth above, rubber sealers are adversely affected. Accordingly, both of the cases above are not preferred.

Preferred examples of phenol ashless antioxidants, which are one of the essential components of the engine oil composition according to the present invention (hereinafter, referred to as the component (e)), include 4,4'-methylenebis(2,6-di-tert-butylphenol),
4,4'-bis(2,6-di-tert-butylphenol),
4,4'-bis(2-methyl-6-tert-butylphenol),
2,2'-methylenebis(4-ethyl-6-tert-butylphenol),
2,2'-methylenbis(4-methyl-6-tert-butylphenol),
4,4'-butylidenebis(3-methyl-6-tert-butylphenol),
4,4'-isopropylidenebis(2,6-di-tert-butylphenol),
2,2'-methylenebis(4-methyl-6-nonylphenol),
2,2'-isobutylidenebis(4,6-dimethylphenol),
2,2'-methylenebis(4-methyl-6-cyclohexylphenol),
2,6-di-tert-butyl-4-methylphenol,
2,6-di-tert-butyl-4-ethylphenol,
2,4-dimethyl-6-tert-butylphenol, 2,6-di-tert-α-dimethylamono-p-cresol,
2,6-di-tert-butyl-4(N,N'-dimethylaminomethylphenol),
4,4'-thiobis(2-methyl-6-tert-butylphenol),
4,4'-thiobis(3-methyl-6-tert-butylphenol),
2,2'-thiobis(4-methyl-6-tert-butylphenol),
bis(3-methyl-4-hydroxy-5-tert-butylbenzyl)sulfide,
bis(3,5-di-tert-butyl-4-hydroxybenzyl)sulfide,
2,2'-thio-diethylenebis[3-(3,5-di-tert-butyl-4-hydroxyphenyl) propionate],
tridecyl-3-(3,5-di-tert-butyl-4-hydroxyphenyl)propionate,
pentaerythrityl-tetrakis[3-(3,5-di-tert-butyl-4-hydroxyphenyl) propionate],
octadecyl-3-(3,5-di-tert-butyl-4-hydroxyphenyl)propionate.

As readily appreciated, those compounds may be used as a mixture thereof.

In the engine oil composition according to the present invention, the amount of the component (e) has an upper limit of 3.0% by weight, preferably 2.0% by weight based on the total weight of the engine oil composition and a lower limit of 0.1% by weight, preferably 0.3% by weight based on the total weight of the engine oil composition. When the amount of the component (e) is less than the lower limit set forth above, the friction factor of the composition increases with deterioration of the engine oil and hence maintaining good fuel consumption is impossible; when the amount of the component (e) is more than the upper limit set forth above, a sufficient antioxidant action can not be effected. Accordingly, both of the cases above are not preferred.

Molybdenum dithiocarbamate friction modifiers which are one of the essential components of the engine oil composition according to the present invention (hereinafter, referred to as the component (f)) include such compounds as represented by the following formula (V):

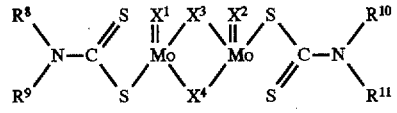

(V)

wherein $R^8$, $R^9$, $R^{10}$, and $R^{11}$ are each independently a hydrocarbon group such as an alkyl, alkenyl, aryl, alkylaryl, or arylalkyl group, preferably an alkyl group; examples of the alkyl group include straight or branched primary, secondary, and tertiary alkyl groups having from 2 to 18, preferably from 8 to 13 carbon atoms as well as an ethyl, propyl, butyl, pentyl, hexyl, heptyl, octyl, nonyl, decyl, undecyl, dodecyl, tridecyl, tetradecyl, pentadecyl, hexadecyl, heptadecyl, or octadecyl group. In addition to those alkyl groups, also included is an alkylaryl group such as a butylphenyl, or nonylphenyl group, in which the alkyl moiety of the alkyaryl group may be straight or branched and the aryl moiety may be substituted by the alkyl moiety at any position.

When $R^8$, $R^9$, $R^{10}$, and $R^{11}$ are introduced, a mixture of α-olefins may be used as a starting material, resulting in a mixture of molybdenum dithiocarbamates each of which as the component (f) has an alkyl group with a different structure.

$X^1$, $X^2$, $X^3$, and $X^4$ are each independently a sulfur atom or an oxygen atom.

Preferred examples of molybdenum thiocarbamate friction modifiers as the component (f) include sulfurized molybdenum diethyldithiocarbamate, sulfurized molybdenum dipropyldithiocarbamate, sulfurized molybdenum dibutyldithiocarbamate, sulfurized molybdenum dipentyldithiocarbamate, sulfurized molybdenum dihexyldithiocarbamate, sulfurized molybdenum dioctyldithiocarbamate, sulfurized molybdenum didecyldithiocarbamate, sulfurized molybdenum didodecyldithiocarbamate, sulfurized molybdenum ditridecyldithiocarbamate, sulfurized molybdenum di(butylphenyl)dithiocarbamate, sulfurized molybdenum di(nonylphenyl)dithiocarbamate, sulfurized oxymolybdenum diethyldithiocarbamate, sulfurized oxymolybdenum dipropyldithiocarbamate, sulfurized oxymolybdenum dibutyldithiocarbamate, sulfurized oxymolybdenum dipentyldithiocarbamate, sulfurized oxymolybdenum dihexyldithiocarbamate, sulfurized oxymolybdenum dioctyldithiocarbamate, sulfurized oxymolybdenum didecyldithiocarbamate, sulfurized oxymolybdenum didodecyldithiocarbamate, sulfurized oxymolybdenum ditridecyldithiocarbamate, sulfurized oxymolybdenum di(butylphenyl)dithiocarbamate, and sulfurized oxymolybdenum di(nonylphenyl)dithiocarbamate.

As readily appreciated, those compounds may be used as a mixture thereof.

In the engine oil composition according to the present invention, the amount of the component (f) has an upper limit of 0.15% by weight, preferably 0.1% by weight based on the total weight of the engine oil composition as converted to the concentration of molybdenum and a lower limit of 0.02% by weight, preferably 0.04% by weight based on the total weight of the engine oil composition as converted to the concentration of molybdenum. When the amount of the component (f) is less than the lower limit set forth above, sufficient reduction in friction can not be achieved; when the amount of the component (f) is more than the upper limit set forth above, oil-insoluble sludge is produced with deterioration of the engine oil. Accordingly, both of the cases above are not preferred.

The engine oil composition according to the present invention consists essentially of the above-mentioned additives; however, a viscosity index improver may be added so that the kinematic viscosity of the composition is in the range of from 5.6 to 12.5 $mm^2/s$ at 100° C.

Viscosity index improvers which are described herein as the component (g) are , for example, polymethacrylates, olefin copolymers or hydrides thereof, graft copolymers of polymethacrylates and olefin copolymers or hydrides thereof, or mixtures of methacrylates and olefin copolymers or hydrides thereof. Examples of the olefin copolymers described above include copolymers of ethylene and α-olefins having from 3 to 18 carbon atoms.

In general, the weight-average molecular weights of polymethacrylates, olefin copolymers or hydrides thereof, and graft copolymers of polymethacrylates and olefin copolymers or hydrides thereof range from 50,000 to 1,000,000, from 10,000 to 500,000, and from 50,000 to 1,000,000, respectively.

As described above, the component (g) is added in such an amount that the kinematic viscosity of the engine oil composition is in the range of from 5.6 to 12.5 $mm^2/s$ at 100° C. In general, the amount of the component (g) ranges from about 1 to about 10% by weight based on the total amount of the engine oil composition.

In addition, it is preferred that sulfur containing organic compounds except components (c) and (f) (hereinafter, referred to as the component (h)) may be incorporated in the composition. Therefore, the component (h) is selected from the group consisting of sulfur containing organic compounds excluding zinc dialkyldithophosphate of the component (c) and molybdenum dithiocarbamate of the component (f).

Examples of the component (h) include sulfurized fats and oils, metal phenates with sulfur bridge(s), dihydrocarbylpolysulfides, dithiocarbamates, and mixtures thereof. Among those examples, metal phenates with sulfur bridge(s), polysulfides, and dithiocarbamates are preferable.

Sulfurized fats and oils as described herein include those which are obtained by adding sulfur to animal and/or vegetable oils with unsaturated bond(s), such as olive oil, castor oil, teaseed oil, rice bran oil, cotton seed oil, rapeseed oil, corn oil, beef tallow, neat's foot oil, sperm oil, and spermaceti.

In addition, metal phenates with sulfur bridge(s) include alkaline earth metal salts of alkylphenol sulfides with alkyl group(s) having from 8 to 30 carbon atoms. Those examples may be represented by the following general formula (VI):

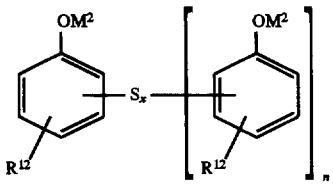

(VI)

wherein $R^{12}$ is a straight or branched alkyl group having from 8 to 30, preferably from 9 to 20 carbon atoms, including a primary, secondary, and tertiary alkyl groups; examples of $R^{12}$ include an octyl, nonyl, decyl, undecyl, dodecyl, tridecyl, tetradecyl, pentadecyl, hexadecyl, heptadecyl, octacdecyl, nonadecyl, icosyl, henicosyl, docosyl, tricosyl, tetracosyl, pentacosyl, hexacosyl, heptacosy, octacosyl, nonacosyl, and triacontyl groups, which may be straight or branched.

In introduction of the alkyl group, a mixture of α-olefins may be used as a starting material, resulting in a mixture of the compounds each of which has a different alkyl group.

In addition, $M^2$ is an alkaline earth metal such as magnesium, calcium, strontium and barium, most preferably calcium and magnesium.

x is an integer of from 1 to 4, preferably 1 to 2; n is an integer of from 1 to 3, preferably 1 to 2.

Furthermore, dihydrocarbylpolysulfides are represented by the following general formula (VII):

$$R^{13}—S_y—R^{14} \quad \text{(VII)}$$

wherein $R^{13}$ and $R^{14}$ are each independently a straight or branched alkyl or alkenyl group, having from 1 to 22 carbon atoms, or an aryl, alkylaryl, or arylalkyl group, having from 6 to 20 carbon atoms; y is an integer of from 1 to 5, preferably from 1 to 2. The alkyl group as described herein includes a primary, secondary, and tertiary alkyl groups.

Examples of $R^{13}$ and $R^{14}$ include alkyl groups, which may be straight or branched, such as a propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, and eicosyl groups; aryl groups, which include all of their isomers, such as a phenyl and naphthyl groups; alkylaryl groups, the alkyl group of which may be straight or branched and the aryl group may be substituted by the alkyl group at any position, such as a tolyl, ethylphenyl, propylphenyl, butylphenyl, pentylphenyl, hexylphenyl, heptylphenyl, octylphenyl, nonylphenyl, decylphenyl, undecylphenyl, dodecylphenyl, xylyl, ethylmethylphenyl, diethylphenyl, dipropylphenyl, dibutylphenyl, methylnaphthyl, ethylnaphthyl, propylnaphthyl, butylnaphthyl, dimethylnaphthyl, ethtylmethylnaphthly, diethylnaphthyl, dipropylnaphthyl, and dibutylnaphthyl groups; and arylalkyl groups, the alkyl group of which may be straight or branched and the alkyl group may be substituted by the aryl group at any position, such as a benzyl, phenylethyl, and phenylpropyl groups.

Preferably, $R^{13}$ and $R^{14}$ of the general formula (VII) include an alkyl group, which includes all of branched isomers thereof, such as an alkyl group derived from propylene or isobutene, having from 3 to 18 carbon atoms; or an aryl, alkylaryl, or arylalkyl group, having from 6 to 8 carbon atoms. Examples of those groups include an alkyl group, which includes all of branched isomers thereof, such as an isopropyl group, a branched hexyl group derived from a propylene dimer, a branched nonyl group derived from a propylene trimer, a branched dodecyl group derived from a propylene tetramer, a branched pentadecyl group derived from a propylene pentamer, a branched octadecyl group derived from a propylene hexamer, a tert-butyl group, a branched octyl group derived from an isobutene dimer, a branched dodecyl group derived from an isobutene trimer, a branched hexadecyl derived from an isobutene tetramer; an alkylaryl group, the alkyl group of which may be straight or branched and the aryl group may be substituted by the alkyl group at any position, such as a phenyl, tolyl, ethylphenyl, and xylyl groups; an arylalkyl group such as a benzyl group and a phenylethyl group, the ethyl group of which may be substituted by the phenyl group at any position.

Furthermore, $R^{13}$ and $R^{14}$ of the general formula (VII) include an alkyl group derived from propylene or isobutene, having from 3 to 18, preferably from 6 to 15 carbon atoms.

Examples of the polysulfide include dibutylpolysulfide, dihexylpolysulfide, dioctylpolysulfide, dinonylpolysulfide, didecylpolysulfide, didodecylpolysulfide, ditetradecylpolysulfide, dihexadecylpolysulfide, dioctadecylpolysulfide, dieicosylpolysulfide, diphenylpolysulfide, dibenzylpolysulfide, diphenetylpolysulfide, polypropenylpolysulfide, polybutenylpolysulfide, and a mixture thereof. Of those examples, polypropenylpolysulfide, polybutenylpolysulfide, and a mixture thereof are most preferred.

Polypropenylpolysulfide, polybutenylpolysulfide, and a mixture thereof as described above may be obtained by sulfurizing an olefinic hydrocarbon such as propylene or isobutene, or a dimer, trimer, or tetramer thereof, or a mixture of the monomer and the polymer thereof with a sulfur atom, sulfur halide such as sulfur monochloride or sulfur dichloride, hydrogen sulfide, or a mixture thereof.

Examples of the dithiocarbamates include alkylthiocarbamic compounds represented by the following general formula (VIII):

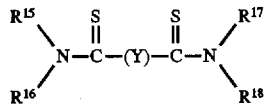

(VIII)

wherein $R^{15}$, $R^{16}$, $R^{17}$, and $R^{18}$ are each independently a straight or branched alkyl group having from 1 to 18, preferably from 1 to 10 carbon atoms; examples of the alkyl group include a methyl, ethyl, propyl, n-butyl, isobutyl, pentyl, isopentyl, hexyl, heptyl, octyl, 2-ethylhexyl, nonyl, decyl, tridecyl, and octadecyl groups. In introduction of the alkyl group, a mixture of α-olefins may be used as a starting material, resulting in a mixture of the alkylthiocarbamic compounds having a plurality of the alkyl groups.

(Y) in the general formula (VIII) represents S, S—S, S—$CH_2$—S, S—$(CH_2)_2$—S, S—$(CH_2)_3$—S, or S—Zn—S.

Examples of the alkyldithiocarbamic compounds in the general formula (VIII) shown above include methylenebis (dibutyldithiocarbamate), bis(dimethylthiocarbamyl) monosulfide, bis(dimethylthiocarbamyl) disulfide, bis (dibutylthiocarbamyl) disulfide, bis(dipentylthiocarbamyl) disulfide, bis(diocylthiocarbamyl) disulfide, and zinc dipentyldithiocarbamate.

In the engine oil composition according to the present invention, the amount of the component (h) has an upper limit of 0.5% by weight, preferably 0.2% by weight based on the total weight of the engine oil composition as converted to the concentration of sulfur and a lower limit of 0.01% by weight, preferably 0.02% by weight based on the total weight of the engine oil composition as converted to the concentration of sulfur. When the amount of the component (h) is less than the lower limit set forth above, a sufficiently long use-life with an excellent fuel consumption efficiency can not be achieved; when the amount of the component (h) is more than the upper limit set forth above, a strong acid tends to be produced with deterioration of the engine oil, resulting in occurrence of rust and corrosion. Accordingly, both of the cases above are not preferred.

The engine oil composition according to the present invention has an excellent performance by itself as an engine oil and maintains good fuel consumption for a long period of time; however, in order to further enhance those performances, known lubricating oil additives may be added by themselves or as a mixture thereof to the engine oil composition according to the present invention.

Examples of the known additives which may be added to the engine oil according to the present invention, include detergents excluding the components (b) and (h), such as alkaline earth metal sulfonates and alkaline earth metal phenates; anti-wear agents such as organic phosphates, organic phosphites, fatty acids, fatty acid esters, and aliphatic alcohols; ashless dispersants excluding the component (d), such as long-chain alkylpolyamines and amides derived from long-chain fatty acids and polyamines; amine antioxidants such as phenyl-α-naphthylamines, alkylphenyl-α-naphthylamines, and dialkyldiphenylamines; friction modifiers excluding the component (f), such as molybdenum dithiophosphates, molybdenum disulfide, long-chain aliphatic amines, long-chain fatty acids, long-chain fatty acid esters, and long-chain aliphatic alcohols; anti-rust agents such as petroleum sulfonate, alkylbenzenesulfonates, dinonylnaphthalenesulfonates, alkenyl succinic acid esters, and polyhydric alcohol esters; demulsifiers typically represented by polyalkyleneglycol-type nonionic surface-active agents such as polyoxyethylenealkylethers, polyoxyethylenealkylphenylethers, and polyoxyethylenealkylnaphthylethers; metal inactivating agents such as imidazoline, pyrimidine derivatives, alkylthiadiazoles, mercaptobenzothiazoles, benzotriazoles or derivatives thereof, 1,3,4-thiadiazolepolysulfides, 1,3,4-thiadiazolyl-2, 5-bisdialkyldithiocarbamates, 2-(alkyldithio) benzoimidazoles, and β-(o-carboxybenzylthio)propionitrile; and anti-foam agents such as silicones, fluorosilicones, and fluoroalkylethers.

In general, when those additives are added to the engine oil composition according to the present invention, the amount of the anti-foam agent is selected in the range of from 0.0005 to 1% by weight, that of the metal inactivating agent is selected in the range of from 0.005 to 1% by weight, and those of the other additives are each selected in the range of from 0.1 to 15% by weight.

The engine oil composition according to the present invention may be suitably utilized as a lubricating oil for use in gasoline engines such as two-wheeled and four-wheeled vehicles, land diesel engines, and marine diesel engines.

EXAMPLE

Hereinafter, the present invention will be further illustrated in conjunction with the following set of examples and comparative examples, and it should be understood that the present invention is not be limited thereto.

The performances of the engine oils used in examples and comparative examples were evaluated by a performance evaluation test.

ENGINE OIL DETERIORATION TEST

The deterioration tests on sample oils were performed using a practical engine on the bench. The engine used was an in-line four-cylinder, one which was of an OHC type, and had a piston displacement of 2.2 $dm^3$. The tests were carried out at an oil temperature of 100° C., at a rotation speed of 3000 rpm, under a pressure of −300 mmHg, and for a period of 50 hours.

The friction characteristics of the virgin sample oils and the degraded oils by the engine tests were evaluated using a SRV reciprocating dynamic friction tester by OPTIMOL. The tests were carried out at a load of 400N, at a frequency of 50 Hz, at an amplitude of 1.5 mm, and at an oil temperature of 80° C.

EXAMPLES 1~4

The results of the performance evaluation test on the engine oils of examples 1~4 are shown together with their compositions in Table 1.

Table 1 shows that the engine oils of examples 1~4 have low friction factors in virgin oil states and maintain the low friction factors after deterioration by the above-mentioned deterioration test.

Therefore, the engine oil composition according to the present invention has excellent properties such as good fuel consumption and capability to maintain the good fuel consumption after deterioration by the above-mentioned deterioration test. Those effects due to the present invention are achieved only by means of the synergistic effect among the individual components, which will be demonstrated hereinafter with reference to comparative examples.

COMPARATIVE EXAMPLE 1

Example 1 was repeated to conduct the deterioration test except that the engine oil contained Ca sulfonate in an amount of 0.68% (1.6% by weight×sulfated ash 42.5% by weight) as sulfated ash instead of the Ca salicylate in an amount of 0.68% (3.5% by weight×sulfated ash 19.5% by weight) as sulfated ash. The results are shown in Table 1.

The virgin oil had a low friction factor; however, its friction factor increased after deterioration and good fuel consumption was not achieved.

COMPARATIVE EXAMPLE 2

Example 1 was repeated to conduct the deterioration test except that the engine oil contained no Ca salicylate. The results are shown in Table 1.

The virgin oil had a low friction factor; however, its friction factor increased after deterioration and good fuel consumption was not achieved.

COMPARATIVE EXAMPLE 3

Example 1 was repeated to conduct the deterioration test except that the amount of zinc dialkyldithiophosphate was decreased from 0.09% (1.25% by weight×phosphorus concentration in the additive 7.2% by weight) to 0.04% (0.54% by weight×phosphorus concentration in the additive 7.2% by weight). The results of the performance evaluation test on the engine oil are shown in Table 1.

The virgin oil had a low friction factor; however, its friction factor increased after deterioration and good fuel consumption was not achieved.

COMPARATIVE EXAMPLE 4

Example 1 was repeated to conduct the deterioration test except that the engine oil contained no zinc dialkyldithiophosphate. The virgin oil had a high friction factor. The results are shown in Table 1.

The deteriorated oil increased its friction factor, resulting in poor fuel consumption.

COMPARATIVE EXAMPLE 5

Example 1 was repeated to conduct the deterioration test except that the engine oil contained no succinimide ashless dispersant. The virgin oil had a high friction factor. The results are shown in Table 1.

The deteriorated oil increased its friction factor, resulting in poor fuel consumption.

COMPARATIVE EXAMPLE 6

Example 1 was repeated to conduct the deterioration test except that the engine oil contained no phenol antioxidant. The results are shown in Table 1.

The virgin oil had a low friction factor; however, its friction factor increased after deterioration and good fuel consumption was not achieved.

COMPARATIVE EXAMPLE 7

Example 1 was repeated to conduct the deterioration test except that the engine oil contained no molybdenum dialkyldithiocarbamate friction modifier. The results are shown in Table 1.

The virgin oil had an extremely high friction factor, resulting in poor fuel consumption.

COMPARATIVE EXAMPLE 8

Example 1 was repeated to conduct the deterioration test except that the engine oil contained a base oil having a total amount of aromatics of 30.2%. The results are shown in Table 1.

The virgin oil had a low friction factor; however, its friction factor increased after deterioration and good fuel consumption was not achieved.

TABLE 1

| Compositions of Sample Oils | | Example | | | | Comparative Example | | | | | | | |
|---|---|---|---|---|---|---|---|---|---|---|---|---|---|
| (% by weight) | | 1 | 2 | 3 | 4 | 1 | 2 | 3 | 4 | 5 | 6 | 7 | 8 |
| Base Oil (1)[1] | | 85.70 | 86.30 | 85.15 | 86.6 | 86.80 | 88.90 | 86.41 | 86.85 | 89.90 | 86.20 | 86.95 | — |
| Base Oil (2)[2] | | — | — | — | — | — | — | — | — | — | — | — | 85.90 |
| Ca Salicylate[3] | | 3.5 | 3.5 | 3.5 | 2.5 | — | — | 3.5 | 3.5 | 3.5 | 3.5 | 3.5 | 3.5 |
| Ca Sulfonate[4] | | — | — | — | — | 1.6 | — | — | — | — | — | — | — |
| ZDTP[5] | | 1.25 | 1.25 | 1.25 | 1.25 | 1.25 | 1.25 | 0.54 | — | 1.25 | 1.25 | 1.25 | 1.25 |
| Succinimide[6] | | 5.0 | 5.0 | 5.0 | 5.0 | 5.0 | 5.0 | 5.0 | 5.0 | — | 5.0 | 5.0 | 5.0 |
| Phenol[7] | | 0.5 | 0.5 | 0.5 | 0.5 | 0.5 | 0.5 | 0.5 | 0.5 | 0.5 | — | 0.5 | 0.5 |
| MoDTC[8] | | 1.25 | 1.25 | 1.80 | 1.25 | 1.25 | 1.25 | 1.25 | 1.25 | 1.25 | 1.25 | — | 1.25 |
| Polymer (1)[9] | | 2.8 | — | 2.8 | 2.9 | 3.6 | 3.1 | 2.8 | 2.9 | 3.6 | 2.8 | 2.8 | 2.6 |
| Polymer (2)[10] | | — | 2.2 | — | — | — | — | — | — | — | — | — | — |
| Kinematic Viscosity ($mm^2/s$, @100° C.) | | 9.9 | 9.8 | 9.9 | 10.0 | 9.8 | 10.0 | 9.8 | 10.1 | 9.8 | 9.9 | 9.9 | 10.0 |
| Friction Factor | Virgin Oil | 0.050 | 0.048 | 0.048 | 0.052 | 0.052 | 0.053 | 0.056 | 0.081 | 0.098 | 0.054 | 0.156 | 0.051 |
| | Deteriorated oil | 0.044 | 0.044 | 0.043 | 0.050 | 0.132 | 0.080 | 0.078 | 0.155 | 0.122 | 0.133 | 0.151 | 0.068 |

Note:

[1]Hydrocracked mineral oil; Kinematic viscosity at 100° C. = 4.8 $mm^2/s$; Total content of aromatics = 8.5% (ASTM D2549).

[2]Solvent refined mineral oil; Kinematic viscosity at 100° C. = 5.0 $mm^2s$; Total content of aromatics = 30.2% (ASTM D2549).

[3]Ca monoalkylsalicylate, containing an alkyl group derived from an α-olefin having from 14 to 16 carbon atoms and over-based with calcium carbonate; Base number (JIS K2501 perchloric acid method) = 167 mgKOH/g; Sulfated ash = 19.5% by weight (JIS K2272).

[4]Base number = 320 mgKOH/g; Sulfated ash = 42.5% by weight.

[5]Zinc dialkyldithiophosphate represented by the following formula:

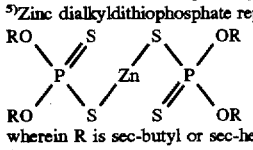

wherein R is sec-butyl or sec-hexyl; Phosphorus concentration = 7.2% by weight.

[6]Succinic acid bisimide ashless dispersant represented by the following formula:

TABLE 1-continued

| Compositions of Sample Oils | Example | | | | Comparative Example | | | | | | | |
|---|---|---|---|---|---|---|---|---|---|---|---|---|
| (% by weight) | 1 | 2 | 3 | 4 | 1 | 2 | 3 | 4 | 5 | 6 | 7 | 8 |

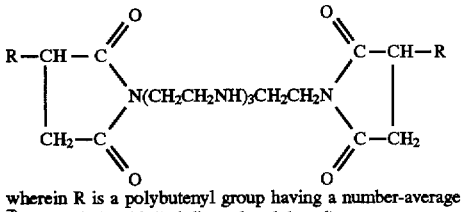

wherein R is a polybutenyl group having a number-average molecular weight of 1300; Nitrogen concentration = 1.7% by weight.

[7)]4,4'-methylenebis(2,6-di-tert-butylphenol).

[8)]Molybdenum dithiocarbamate friction modifier represented by the following formula:

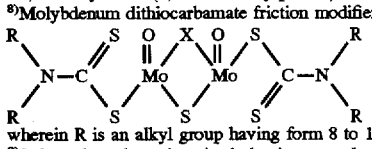

wherein R is an alkyl group having form 8 to 13 carbon atoms, and X is O or S; Mo concentration = 4.8% by weight.

[9)]Polymethacrylate viscosity index improver having a weight-average molecular weight of 350,000.

[10)]Olefin copolymer (copolymer of ethylene and propylene) having a weight-average molecular weight of 175,000.

ENGINE OIL DETERIORATION TEST

The deterioration tests on sample oils were performed following the above-mentioned conditions except that the period of time was changed from 50 hours to 75 hours.

The friction characteristics of the virgin oils and deteriorated oils by the engine test were evaluated as described above.

EXAMPLE 5~8

The engine oils with their compositions shown in Table 2 were subjected to the performance evaluation tests for Examples 5~8. The results are shown in Table 1.

Table 2 shows that the engine oils in Examples 5~8 had low friction factors as virgin oils and maintained the low friction factors after deterioration by the above-mentioned deterioration tests.

Therefore, the engine oil composition according to the present invention has excellent properties such as good fuel consumption and capability to maintain the good fuel consumption after deterioration by the above-mentioned deterioration test. Those effects due to the present invention are achieved only by means of the synergistic effect among the individual components, which will be demonstrated hereinafter with reference to comparative examples.

COMPARATIVE EXAMPLE 9

Example 5 was repeated to conduct the deterioration test except that the engine oil contained Ca sulfonate in an amount of 0.68% (1.6% by weight×sulfated ash 42.5% by weight=0.68% by weight) as sulfated ash instead of the Ca salicylate in an amount of 0.68% (3.5% by weight×sulfated ash 19.5% by weight=0.68% by weight) as sulfated ash. Polymer was added in such an amount that the kinematic viscosity came close to 9.9 $mm^2/s$ as in Example 5. A part of the engine oil composition comprised of the additives; the remainder was made up of base oil. The results of the performance evaluation test on the engine oil are shown in Table 2.

The virgin oil had a low friction factor; however, its friction factor increased after deterioration and good fuel consumption was not achieved.

COMPARATIVE EXAMPLE 10

Example 5 was repeated to conduct the deterioration test except that the engine oil contained no Ca salicylate. Polymer was added in such an amount that the kinematic viscosity came close to 9.9 $mm^2/s$ as in Example 5. A part of the engine oil composition comprised of the additives; the remainder was made up of base oil. The results of the performance evaluation test on the engine oil are shown in Table 2.

The virgin oil had a low friction factor; however, its friction factor increased after deterioration and good fuel consumption was not achieved.

COMPARATIVE EXAMPLE 11

Example 5 was repeated to conduct the deterioration test except that the amount of zinc dialkyldithiophosphate was decreased from 0.09% (1.25% by weight×phosphorus concentration in the additive 7.2% by weight=0.09% by weight) to 0.04% (0.54% by weight×phosphorus concentration in the additive 7.2% by weight=0.04% by weight). Polymer was added in such an amount that the kinematic viscosity came close to 9.9 $mm^2/s$ as in Example 5. A part of the engine oil composition comprised of the additives; the remainder was made up of base oil. The results of the performance evaluation test on the engine oil are shown in Table 2.

The virgin oil had a low friction factor; however, its friction factor increased after deterioration and good fuel consumption was not achieved.

COMPARATIVE EXAMPLE 12

Example 5 was repeated to conduct the deterioration test except that the engine oil contained no zinc dialkyldithiophosphate. Polymer was added in such an amount that the kinematic viscosity came close to 9.9 $mm^2/s$ as in Example 5. A part of the engine oil composition comprised of the additives; the remainder was made up of base oil. The results of the performance evaluation test on the engine oil are shown in Table 2.

The virgin oil had a high friction factor. The deteriorated oil increased its friction factor, resulting in poor fuel consumption.

COMPARATIVE EXAMPLE 13

Example 5 was repeated to conduct the deterioration test except that the engine oil contained no succinimide ashless dispersant. Polymer was added in such an amount that the kinematic viscosity came close to 9.9 $mm^2/s$ as in Example 5. A part of the engine oil composition comprised of the additives; the remainder was made up of base oil. The results of the performance evaluation test on the engine oil are shown in Table 2.

The virgin oil had a high friction factor. The deteriorated oil increased its friction factor, resulting in poor fuel consumption.

COMPARATIVE EXAMPLE 14

Example 5 was repeated to conduct the deterioration test except that the engine oil contained no phenol antioxidant. Polymer was added in such an amount that the kinematic viscosity came close to 9.9 $mm^2/s$ as in Example 5. A part of the engine oil composition comprised of the additives; the remainder was made up of base oil. The results of the performance evaluation test on the engine oil are shown in Table 2.

The virgin oil had a low friction factor; however, its friction factor increased after deterioration and good fuel consumption was not achieved.

COMPARATIVE EXAMPLE 15

Example 5 was repeated to conduct the deterioration test except that the engine oil contained no molybdenum dialkyldithiocarbamate friction modifier. Polymer was added in such an amount that the kinematic viscosity came close to 9.9 $mm^2/s$ as in Example 5. A part of the engine oil composition comprised of the additives; the remainder was made up of base oil. The results of the performance evaluation test on the engine oil are shown in Table 2.

The virgin oil had an extremely high friction factor, resulting in poor fuel consumption.

COMPARATIVE EXAMPLE 16

Example 5 was repeated to conduct the deterioration test except that the engine oil contained a base oil having a total amount of aromatics of 30.2%. Polymer was added in such an amount that the kinematic viscosity came close to 9.9 $mm^2/s$ as in Example 5. A part of the engine oil composition comprised of the additives; the remainder was made up of base oil. The results of the performance evaluation test on the engine oil are shown in Table 2.

The virgin oil had a low friction factor; however, its friction factor increased after deterioration and good fuel consumption was not achieved.

TABLE 2

| Compositions of Sample Oils | | Example | | | | Comparative Example | | | | | | | |
|---|---|---|---|---|---|---|---|---|---|---|---|---|---|
| (% by weight) | | 5 | 6 | 7 | 8 | 9 | 10 | 11 | 12 | 13 | 14 | 15 | 16 |
| Base Oil (1)[1] | | 85.20 | 85.80 | 84.65 | 86.10 | 86.30 | 88.40 | 85.91 | 86.35 | 89.40 | 85.70 | 86.45 | — |
| Base Oil (2)[2] | | — | — | — | — | — | — | — | — | — | — | — | 85.40 |
| Ca Salicylate[3] | | 3.5 | 3.5 | 3.5 | 2.5 | — | — | 3.5 | 3.5 | 3.5 | 3.5 | 3.5 | 3.5 |
| Ca Sulfonate[4] | | — | — | — | — | 1.6 | — | — | — | — | — | — | — |
| ZDTP[5] | | 1.25 | 1.25 | 1.25 | 1.25 | 1.25 | 1.25 | 0.54 | — | 1.25 | 1.25 | 1.25 | 1.25 |
| Succinimide[6] | | 5.0 | 5.0 | 5.0 | 5.0 | 5.0 | 5.0 | 5.0 | 5.0 | — | 5.0 | 5.0 | 5.0 |
| Phenol[7] | | 0.5 | 0.5 | 0.5 | 0.5 | 0.5 | 0.5 | 0.5 | 0.5 | 0.5 | — | 0.5 | 0.5 |
| MoDTC[8] | | 1.25 | 1.25 | 1.80 | 1.25 | 1.25 | 1.25 | 1.25 | 1.25 | 1.25 | 1.25 | — | 1.25 |
| Ca sulfurized phenate[9] | | 0.5 | 0.5 | — | — | 0.5 | 0.5 | 0.5 | 0.5 | 0.5 | 0.5 | — | 0.5 |
| Polysulfide[10] | | — | — | 0.5 | — | — | — | — | — | — | — | — | — |
| Zn dithiocarbate[11] | | — | — | — | 0.5 | — | — | — | — | — | — | — | — |
| Polymer (1)[12] | | 2.8 | — | 2.8 | 2.9 | 3.6 | 3.1 | 2.8 | 2.9 | 3.6 | 2.8 | 2.8 | 2.6 |
| Polymer (2)[13] | | — | 2.2 | — | — | — | — | — | — | — | — | — | — |
| Kinematic Viscosity ($mm^2/s$, @100° C.) | | 9.9 | 9.8 | 9.9 | 10.0 | 9.8 | 10.0 | 9.8 | 10.1 | 9.8 | 9.9 | 9.9 | 10.0 |
| Friction Factor | Virgin Oil | 0.050 | 0.049 | 0.046 | 0.049 | 0.055 | 0.056 | 0.056 | 0.075 | 0.078 | 0.052 | 0.140 | 0.051 |
| | Deteriorated oil | 0.051 | 0.050 | 0.043 | 0.048 | 0.138 | 0.110 | 0.125 | 0.155 | 0.122 | 0.098 | 0.151 | 0.065 |

Note:

[1]Hydrocracked mineral oil; Kinematic viscosity at 100° C. = 4.8 $mm^2/s$; Total content of aromatics = 8.5% (ASTM D2549).

[2]Solvent refined mineral oil; Kinematic viscosity at 100° C. = 5.0 $mm^2s$; Total content of aromatics = 30.2% (ASTM D2549).

[3]Ca monoalkylsalicylate, containing an alkyl group derived from an α-olefin having from 14 to 16 carbon atoms and over-based with calcium carbonate; Base number (JIS K2501 perchloric acid method) = 167 mgKOH/g; Sulfated ash = 19.5% by weight (JIS K2272).

[4]Base number = 320 mgKOH/g; Sulfated ash = 42.5% by weight.

[5]Zinc dialkyldithiophosphate represented by the following formula:

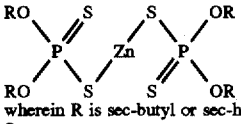

wherein R is sec-butyl or sec-hexyl; Phosphorus concentration = 7.2% by weight.

[6]Succinic acid bisimide ashless dispersant represented by the following formula:

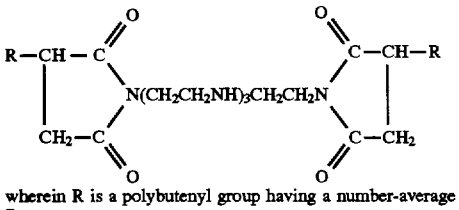

wherein R is a polybutenyl group having a number-average molecular weight of 1300; Nitrogen concentration = 1.7% by weight.

[7]4,4'-methylenebis(2,6-di-tert-butylphenol).

[8]Molybdenum dithiocarbamate friction modifier represented by the following formula:

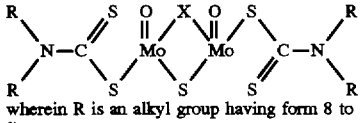

wherein R is an alkyl group having form 8 to 13 carbon atoms, and X is O or S; Mo concentration = 4.8% by weight.

[9]A mixture of calcium sulfurized phenates containingalkyl groups derived from α-olefins having 9 carbon atoms, represented by the following formula:

TABLE 2-continued

| Compositions of Sample Oils | Example | | | | Comparative Example | | | | | | | |
|---|---|---|---|---|---|---|---|---|---|---|---|---|
| (% by weight) | 5 | 6 | 7 | 8 | 9 | 10 | 11 | 12 | 13 | 14 | 15 | 16 |

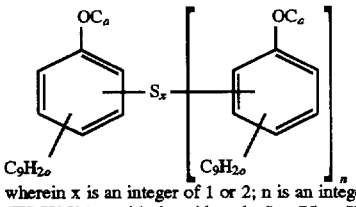

wherein x is an integer of 1 or 2; n is an integer of from 1 to 3. Sulfur = 7.5% by weight; calcium = 2.6% by weight; Base number (JIS K2501 perchloric acid method) = 75 mgKOH/g.

[10]A mixture of dihydrocarbylpolysulfides produced from isobutene trimers, represented by the following formular:

$C_{12}H_{25}-S_y-C_{12}H_{25}$ wherein y is an integer of 1 or 2. Sulfur = 10% by weight.

[11]Zinc dipentyldithiocarbamate represented by the following formula:

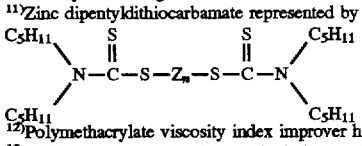

[12]Polymethacrylate viscosity index improver having a weight-average molecular weight of 350,000.

[13]Olefin copolymer (copolymer of ethylene and propylene) having a weight-average molecular weight of 175,000.

As shown in each comparative example, combination of base oil having a specified total amount of aromatics and specified additives is important. Such combination provides an engine oil which has good fuel consumption and maintains the good fuel consumption for a long period of time. However, when one or more of the additives are lacking or their amounts and the total amount of aromatics do not fall within the scope of the present invention, an excellent engine oil with good fuel consumption maintained for a long period of time can not be obtained.

The engine oil according to the present invention has a synergistic effect among the additives and thereby exhibits a low friction factor for both of the virgin oil and the deteriorated oil. Therefore, there is provided an excellent oil with good fuel consumption maintained for a long period of time.

What is claimed is:

1. An engine oil composition comprising:

(a) a base oil having a kinematic viscosity of from 2 to 8 $mm^2/s$ at 100° C. and a total amount of aromatics of 2 to 15% by weight;

(b) calcium salicylate detergent in an amount of from 0.5 to 1.2% by weight as converted to the concentration of sulfated ash;

(c) a zinc dialkyldithiophosphate in an amount of from 0.04 to 0.10% by weight as converted to the concentration of phosphorus;

(d) a succinimide ashless dispersant in an amount of from 0.05 to 0.20% by weight as converted to the concentration of nitrogen, the succinimide ashless dispersant containing a polybutenyl group having a number-average molecular weight of from 900 to 3500;

(e) a phenol ashless antioxidant in an amount of from 0.1 to 3.0% by weight;

(f) a molybdenum dithiocarbamate friction modifier in an amount of from 0.02 to 0.15% by weight as converted to the concentration of molybdenum; and (g) a viscosity index improver in such an amount that the kinematic viscosity of said composition ranges from 5.6 to 12.5 $mm^2/s$ at 100° C. and selected from the group consisting of ethylene-propylene copolymer, polymethacrylate, graft copolymer of ethylene-propylene copolymer and polymethacrylate and mixtures thereof of ethylene-propylene copolymer and polymethacrylate, said improver having a molecular weight range of from 50,000 to 1,000,000;

wherein the weight percentages in the components (b), (c), (d), (e) and (f) are based on the total weight of said engine oil composition.

2. An engine oil composition according to claim 1 wherein said engine oil composition further comprises (h) a sulfur-containing organic compound excluding said component (c) and said component (f), in an amount of from 0.01 to 0.5% by weight based on the total weight of said engine oil composition as converted to the concentration of sulfur.

3. An engine oil composition according to claim 2 wherein said component (h) is selected from the group consisting of sulfurized fats and oils, metal phenates with sulfur bridge(s), dihydrocarbylpolysulfides, dithiocarbamates, and mixtures thereof.

4. An engine oil composition according to claim 3 wherein the amount of component (d) is from 0.05 to 0.1% by weight, the amount of component (e) is 0.3 to 2% by weight and the amount of component (f) is from 0.04 to 0.1% by weight.

5. An engine oil composition according to claim 3 wherein the total amount of aromatics is 2–8% by weight.

6. An engine oil composition according to claim 5 in which the amount of component (h) is from 0.02 to 0.2% by weight.

7. An engine oil composition according to claim 2 wherein, the amount of component (d) is from 0.05 to 0.1% by weight, the amount of component (e) is 0.3 to 2% by weight and the amount of component (f) is from 0.04 to 0.1% by weight.

8. An engine oil composition according to claim 7 wherein the total amount of aromatics is 2–8% by weight.

9. An engine oil composition according to claim 8 in which the amount of component (h) is from 0.02 to 0.2% by weight.

10. An engine oil composition according to claim 1 wherein the amount of component (d) is from 0.05 to 0.1% by weight, the amount of component (e) is 0.3 to 2% by weight and the amount of component (f) is from 0.04 to 0.1% by weight.

11. An engine oil composition according to claim 10 wherein the total amount of aromatics is 2–8% by weight.

* * * * *